US006012186A

United States Patent [19]

Soltani et al.

[11] Patent Number: 6,012,186

[45] Date of Patent: Jan. 11, 2000

[54] MATTRESS ARTICULATION STRUCTURE

[75] Inventors: Sohrab Soltani, Charleston; David N. Ashcraft, Mt. Pleasant; Timothy W. Perez; James J. Romano, both of James Island; Elizabeth D. Kerrigan, Mt. Pleasant, all of S.C.

[73] Assignee: Hill-Rom Compnay, Inc., Batesville, Ind.

[21] Appl. No.: 08/841,125

[22] Filed: Apr. 29, 1997

[51] Int. Cl.[7] ..... A61G 7/10

[52] U.S. Cl. ..... 5/614; 5/617; 5/618; 5/613

[58] Field of Search ..... 5/613, 614, 615, 5/617, 618

[56] References Cited

U.S. PATENT DOCUMENTS

| | | | |
|---|---|---|---|
| 10,139 | 10/1853 | Scott . | |
| 1,772,310 | 8/1930 | Hart . | |
| 3,392,412 | 7/1968 | Aymar . | |
| 3,492,988 | 2/1970 | De Mare . | |
| 3,606,623 | 9/1971 | Aymar . | |
| 3,667,075 | 6/1972 | Ballard et al. . | |
| 3,781,928 | 1/1974 | Swallert | 5/615 |
| 4,287,620 | 9/1981 | Zur . | |
| 4,525,885 | 7/1985 | Hunt et al. . | |
| 4,527,298 | 7/1985 | Moulton | 5/615 |
| 4,559,655 | 12/1985 | Peck . | |
| 4,628,557 | 12/1986 | Murphy . | |
| 4,745,647 | 5/1988 | Goodwin . | |
| 4,751,754 | 6/1988 | Bailey et al. . | |
| 4,768,249 | 9/1988 | Goodwin . | |
| 4,798,227 | 1/1989 | Goodwin . | |
| 4,807,313 | 2/1989 | Ryder et al. | 5/615 |
| 4,839,932 | 6/1989 | Williamson | 5/613 |
| 4,873,731 | 10/1989 | Williamson | 5/613 |
| 4,873,737 | 10/1989 | Savenije . | |
| 4,896,389 | 1/1990 | Chamberland . | |
| 4,934,002 | 6/1990 | Watanabe . | |
| 4,935,968 | 6/1990 | Hunt et al. . | |
| 4,941,221 | 7/1990 | Hanzler . | |
| 4,949,413 | 8/1990 | Goodwin . | |
| 4,949,414 | 8/1990 | Thomas et al. . | |
| 4,977,629 | 12/1990 | Jones | 5/61 |
| 5,095,568 | 3/1992 | Thomas et al. . | |
| 5,103,519 | 4/1992 | Hasty . | |
| 5,170,522 | 12/1992 | Walker . | |
| 5,251,349 | 10/1993 | Thomas et al. . | |
| 5,279,010 | 1/1994 | Ferrand et al. . | |
| 5,325,551 | 7/1994 | Tappel et al. . | |
| 5,331,698 | 7/1994 | Newkirk et al. . | |
| 5,367,728 | 11/1994 | Chang . | |
| 5,375,910 | 12/1994 | Murphy . | |
| 5,491,854 | 2/1996 | Music | 5/618 |
| 5,575,026 | 11/1996 | Way et al. | 5/617 |
| 5,577,278 | 11/1996 | Barker et al. . | |

FOREIGN PATENT DOCUMENTS

| | | |
|---|---|---|
| 122806 | 2/1919 | United Kingdom . |

OTHER PUBLICATIONS

Health–Mor, Inc., "The Comfort Care Bed by Heath–Mor", (Date Unknown).

Hammacher Schlemmer, "Fully Adjustable Comfort Bed", Christmas 1995.

*Primary Examiner*—Michael F. Trettel
*Assistant Examiner*—Frederick Conley
*Attorney, Agent, or Firm*—Barnes & Thornburg

[57] ABSTRACT

An apparatus is provided to support a mattress. The apparatus includes a base platform that is formed to rest on a box spring and to include slots therethrough, a plate hinged to the base platform, and a bladder fastened between the plate and the base platform. In addition, the apparatus includes a fastener mechanism coupled to the plate and adapted to block sliding movement of the mattress relative to the plate and a strap coupled to the base platform. The strap extends through the slots and is configured to extend about the box spring to hold the base platform on the box spring.

49 Claims, 7 Drawing Sheets

MATTRESS ARTICULATION STRUCTURE

BACKGROUND SUMMARY OF THE INVENTION

The present invention relates to a mattress structure that includes an articulatable platform, and more particularly to a mattress structure that includes a base platform, top plates hinged to the platform, and inflatable bladders coupled to the top plates and the base platform.

Many people, especially those with medical conditions, have beds that include air mattresses. Air mattresses are often formed from several bladders or air sacks that support the person and provide adjustable support and firmness characteristics. See for example, U.S. Pat. Nos. 4,896,389 to Chamberland and 4,949,413 to Goodwin. Often, a user of these air mattresses also needs to elevate their feet, and/or their head periodically.

It is known that beds are manufactured to have articulated frames with head and leg sections that the user of the bed can raise and lower. A person using these beds are therefore able to adjust their head and/or legs to a desired inclined position. See for example U.S. Pat. Nos. 4,559,655 to Peck and 4,751,754 to Bailey et al. Beds that have articulated frames are often expensive and are commonly quite heavy.

In the past, inflatable bodies have been used to elevate whole or selected portions of an air mattress of a bed. See U.S. Pat. No. 5,170,522 to Walker. Side-to-side stability is, however, a concern when an air mattress is positioned upon inflatable bodies. For example, as a person resting on the air mattress rolls over or leans to the side, the relative movement of the air mattress on the supporting inflatable body can create the sensation of falling or instability. What is needed is an articulatable mattress platform that prevents side-to-side movement of an air mattress situated on the platform when the person resting on the mattress rolls, leans, or turns, especially during articulation of the mattress. A mattress apparatus that can convert a stationary platform of a bed to an articulatable platform and is foldable for easy transportation, and particularly a mattress apparatus that includes several inflatable bladder segments maximizing the apparatus' response time to the user's command input, would be appreciated by users of such systems. In addition, a mattress apparatus that can be adjusted so that the elevated positioning of various sections of the mattress are easily changed to suit the needs of the person supported on top of the mattress would be welcomed by users of such apparatuses.

According to the present invention a mattress structure for converting a platform such as a box spring on a bed to an articulatable platform for the bed is provided.

The mattress structure comprises a mattress, a base platform that is formed to rest on the box spring, first and second top plates hinged on the base platform, a head-end bladder fastened between the first top plate and the base platform, and a foot-end bladder fastened between the second top plate and the base platform. The mattress structure further comprises a fastener mechanism that both holds the mattress on the top plates and limits side-to-side movement of the mattress on the top plates. In addition, an attachment mechanism holds the base platform on the box spring.

According to another embodiment of the present invention a bed is provided. The bed comprises a base platform and first and second top plates. Each top plate includes opposite edges and an inner end that extends between the edges and is pivotally coupled to the base platform. The bed further comprises a first bladder positioned between the first top plate and the base platform, a second bladder positioned between the second top plate and the base platform, and a mattress positioned on the first and second top plates and formed to include opposite ends and opposite edges that extend between the ends. The bed further comprises a fastener mechanism coupled to the top plates and mattress. The faster mechanism is configured to prevent substantial sliding movement of the opposite edges of the mattress across the opposite edges of the top plates, that holds the mattress on the top plates.

A support structure for a person is provided in another embodiment of the present invention. The support structure comprises a frame that has opposite ends and side edges extending between the ends, a base platform that is carried by the frame and includes a central block portion and a first and second bottom plates. The bottom plates extend from the central block portion in opposite directions and toward opposite ends of the frame. In addition, the support structure has inflatable bladders that are carried by the first and second bottom plates. Top plates are hinged to the block portion of the base platform and rest upon the inflatable bladders. The support structure further comprises an air mattress that is positioned to lie on the top plates and a holding means for keeping the air mattress on the top plates so that the mattress is prevented from sliding over the side edges of the frame.

In yet another embodiment of the present invention an articulatable structure suited for use with a mattress is provided. The structure comprises a base platform, a head plate pivotably coupled to the base platform for support in a head portion of the mattress, and a knee plate pivotably coupled to the base platform for supporting a leg portion of the mattress. The structure further comprises a first bladder located between the base platform and the head plate to raise and lower the head plate and a second bladder located between the base platform and the knee plate to raise and lower the knee plate. In addition, a controller is provided for selectively inflating and deflating the first and second bladders to raise the head and knee plates and the head and leg portions of the mattress located thereon. The controller is configured to inflate the second bladder each time an operator inflates the first bladder so that the knee plate always moves to an elevated position as the head plate is elevated.

In still another embodiment of the present invention a bed is provided. The bed comprises a base platform and first and second top plates. Each top plate includes opposite edges and an inner end that extends between the edges and is pivotally coupled to the base platform. The bed further comprises a first bladder positioned between the first top plate and the base platform, a second bladder positioned between the second top plate and the base platform, and an air mattress positioned to lie on the first and second top plates. In addition, the bed comprises a first source of pressurized fluid coupled to the air mattress and a second source of pressurized fluid coupled to the first and second bladders.

In another embodiment of the present invention a structure for converting a platform to an articulatable platform that supports a mattress thereon is provided. The structure comprises a base platform having a first bottom plate, a second bottom plate, and a hinge coupled to the first and second bottom plates and first and second top plates. Each top plate has opposite edges and an inner end extending between the opposite edges and pivotally coupled to the base platform. In addition, the structure comprises a first bladder positioned between the first top plate and the first bottom plate, a second bladder positioned between the second top plate and the second bottom plate, a first conduit coupled to the first bladder to supply fluid to the first bladder, and a conduit assembly coupled to the second bladder to supply fluid to the second bladder. The conduit assembly includes a tube and a living hinge that extends between the first and second bottom plates.

Further, a structure for converting a platform to an articulatable platform that supports a mattress thereon is provided in accordance with the present invention. The structure comprises a base platform including a mounting slot therethrough and first and second top plates. Each top plate includes opposite edges, an inner hinged end that extends between the opposite edges and is pivotally coupled to the base platform, and at least one mounting slot extending therethrough. In addition, the structure comprises a first bladder that is positioned to lie between the first top plate and the base platform. The first bladder includes a top tab sized for extension through the mounting slot in the first top plate and a bottom slot sized for extension through the mounting slot in the base platform. Further, the structure comprises a second bladder positioned to lie between the second top plate and the base platform and mounting brackets. The second bladder includes a top tab sized for extension through the mounting slot in the second top plate and a bottom tab sized for extension through the mounting slot in the base platform. The mounting brackets are coupled to the top and bottom tabs and prevent the top and bottom mounting tabs from sliding through the mounting slots. In addition, the mounting brackets hold the first and second bladders between the first and second top pates and the base platform.

In yet another embodiment of the present invention, an articulatable apparatus for use with a mattress upon which a person rests is provided. The articulatable apparatus comprising a base platform including first and second portions, a head top plate pivotably coupled to the base platform over the first portion, and a knee top plate pivotably coupled to the base portion over the second portion. The apparatus further comprises a first inflatable bladder located between the first portion of the base platform and the head plate, a second bladder located between the second portion of the base platform and the knee plate, a first reinforcement bar coupled to the first portion of the base platform, and a second reinforcement bar coupled to the head plate to stabilize the head plate.

Additional objects, features, and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
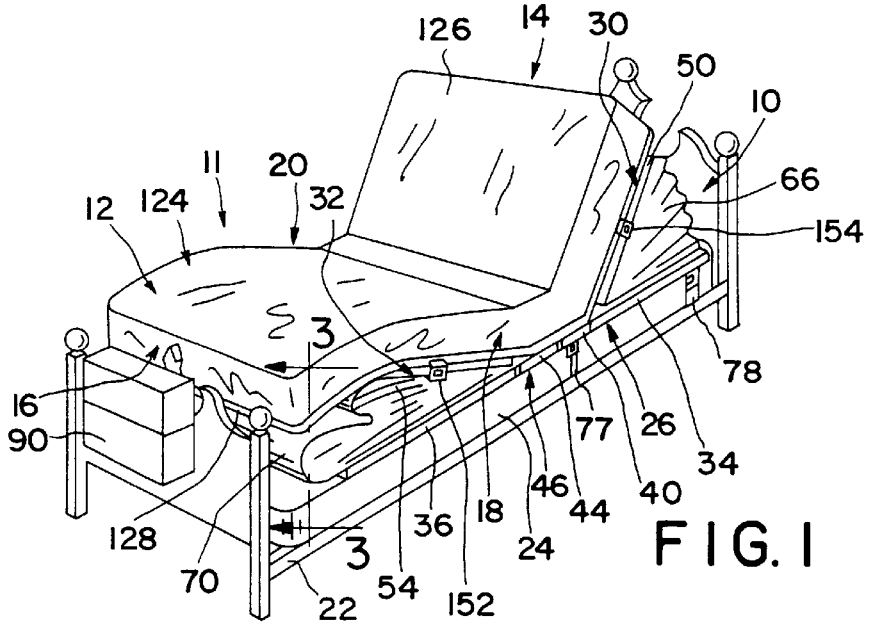
FIG. 1 is a perspective view of a bed having a box spring, a mattress, and a bellows assembly in accordance with the present invention sandwiched between the box spring and the mattress and showing the bellows assembly having an inflated head-end bladder and an inflated foot-end bladder.

A bellows assembly 10 in accordance with the present invention is positioned to lie in a bed 11 carrying a mattress, a mattress overlay, or a mattress replacement system 12 (hereinafter mattress 12) having a head end 14, a foot end 16 longitudinally spaced-apart from head end 14, a longitudinally-extending first edge 18 therebetween, and a longitudinally-extending second edge 20 spaced apart from the first edge 18 as shown in FIG. 1. Although illustrative bed 11 is a bed for 'in-home' use by customers, bellows assembly 10 in accordance with the present invention is equally appropriate for use both in an institutional facility and for use in a hospital or a group care home.

As used in this description, the phrase "head end 14" will be used to denote the end of any referred-to object that is positioned to lie nearest head end 14 of bed 11 and the phrase "foot end 16" will be used to denote the end of any referred-to object that is positioned to lie nearest the foot end 16 of bed 11. Also, the phrase "first edge 18" will be used to denote the edge of any referred-to object that is positioned to lie nearest the first edge 18 of bed 11 and the phrase "second edge 20" will be used to denote the edge of any referred-to object that is positioned to lie nearest the second edge 20 of bed 11.

As described above, bed 11 can be any bed for use in a home, a bed for use in a hospital or other care facility, or any other type of bed having an upwards-facing surface above which a person rests. Bed 11 includes a frame 22 carrying a box spring 24. See FIG. 1. Illustrative box spring 24 supports the bellows assembly 10 of the present invention. Bellows assembly 10 articulates and includes longitudinally-spaced sections. These sections are moveable relative to one another. Mattress 12 can be compatible with the bellows assembly 10 in that mattress 12 can be formed to include longitudinally-spaced sections that are moveable relative to one another and that are moveable with the associated sections of articulating bellows assembly 10.

Figure 5:
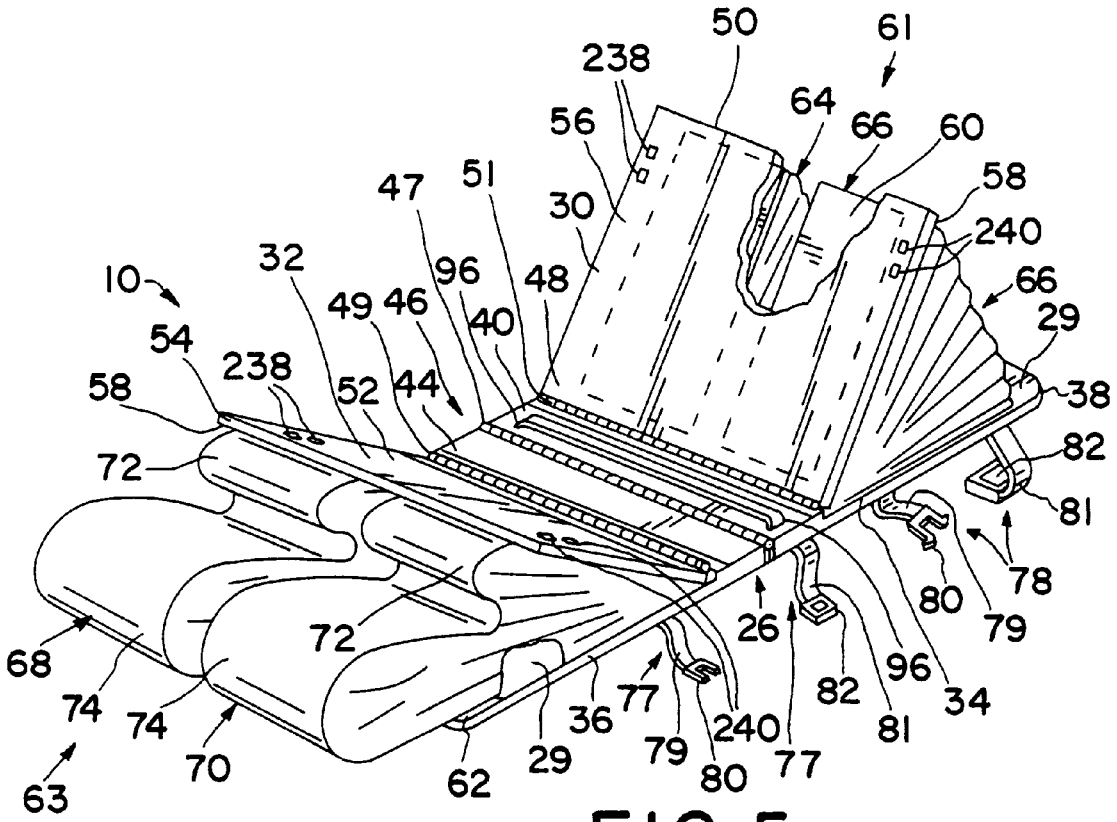
FIG. 5 is a perspective view of the bellows assembly of FIG. 1 with portions broken away showing the bellows assembly having a base platform, a head-end top plate and a foot-end top plate pivotally connected to the base platform, two head-end bladder segments fixed between the head-end top plate and the base platform and two foot-end bladder segments fixed between the foot-end top plate and the base platform, and straps movably attached to the base platform for extension around the box spring.

The bellows assembly 10 of the present invention beneficially provides side-to-side stability to a mattress 12 upon which a person rests during turning or rolling movement of that person on the mattress 12 during articulation of the bellows assembly 10. The bellows assembly 10 is also foldable to allow the user to transport the bellows assembly 10 easily around the household or during travel. As best shown in FIG. 5, the bellows assembly 10 of the present invention includes a base platform 26, inflatable bladders or sacks 61, 63 (hereinafter bladders) resting on the base platform 26, and top plates 30, 32 pivotally mounted on the platform 26 and resting on the bladders 61, 63. These bladders 61, 63 are formed as bladder segments 64, 66, 68, 70 in order to consume less fluid during inflation when compared to a traditional single bladder and therefore minimize the response time to a person's command input into the bellows assembly 10. Although bladder segments 64, 66 and 68, 70 are shown in a side-by-side relationship, it is understood that greater than two bladder segments may be fixed in a side-by-side relationship on the base platform 26.

Figure 2:
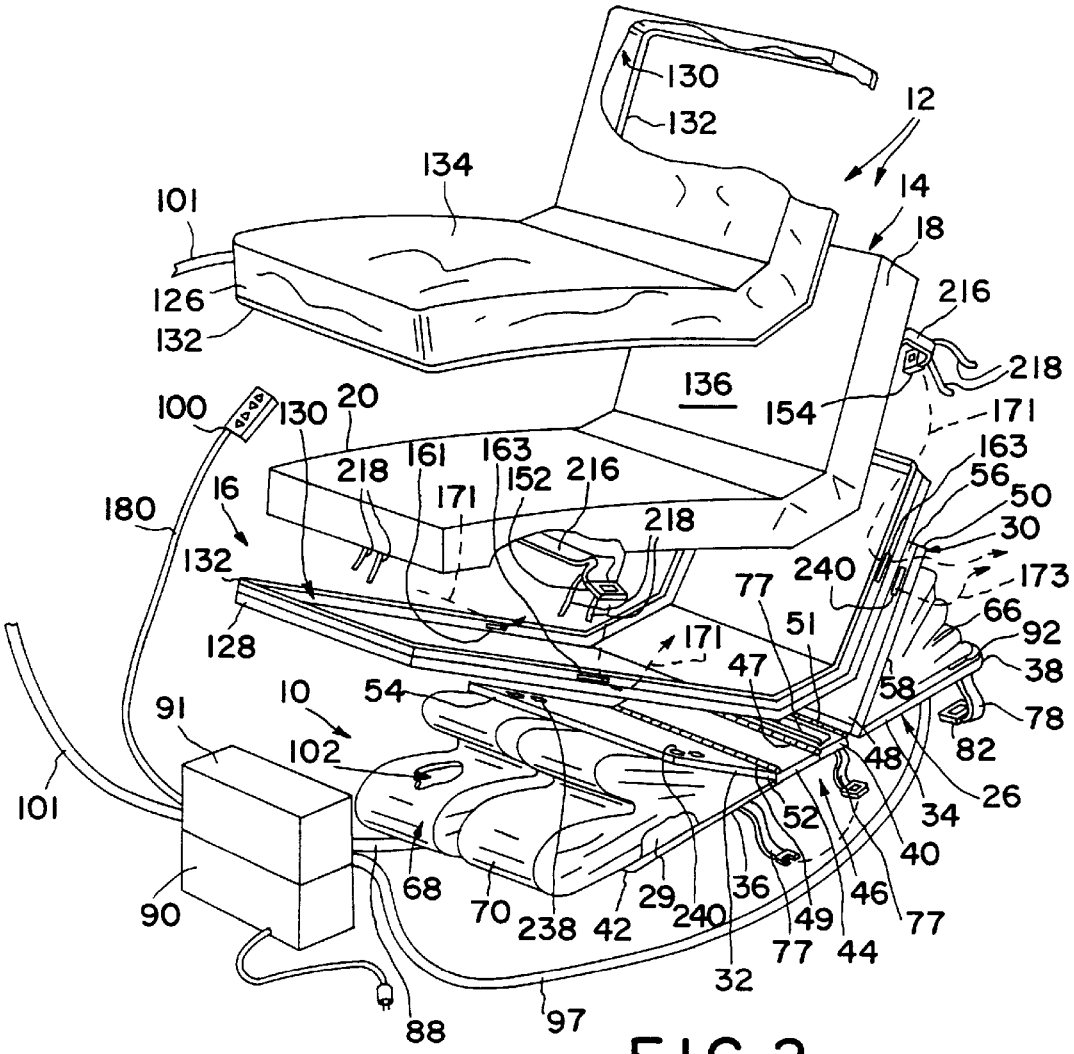
FIG. 2 is an exploded perspective view of the mattress and of the bellows assembly of FIG. 1 with a portion broken away showing the mattress having a top cover, a mattress core, and a bottom cover, the bellows assembly having two top plates hinged to a base platform, each top plate having apertures therethrough, and belts coupled to the mattress core and formed for extension through the apertures.

The base platform 26 of assembly 10 also includes a top surface 29 that engages the bladder segments 64, 66, 68, 70 and an opposite bottom surface 31 that is formed to engage the box spring 24. See FIGS. 3 and 4. Specifically, the platform 26 has a first head-end bottom plate 34 that receives the head-end bladder segments 64, 66 and a second foot-end bottom plate 36 that is sized to receive the foot-end bladder segments 68, 70. The head-end bottom plate 34 of the base platform 26 includes an outer end 38 positioned to lie adjacent the head end 14 of the mattress 12 and an opposite inner end formed as a first raised block portion 40. See FIG. 2. Similarly, the second foot-end bottom plate 36 includes an outer end 42 and an opposite inner end formed as a second raised block portion 44. The first and second block portions 40, 44 of the opposite bottom plates 34, 36 are coupled to form a central raised block portion 46 of the base platform 26 to which the top plates 30, 32 are coupled. As shown in FIGS. 2 and 5, a pivot hinge 47 is positioned between block portions 40, 44 at the top surface 29 of the platform 26. As discussed later in the specification in greater detail, a user of the bellows assembly 10 can easily fold the base platform 26 at the hinge 47 and create a compact folded assembly. See FIG. 7.

Each of the top plates 30, 32 are coupled to the base platform 26 and include an upper surface 56 formed to engage the mattress 12 and an opposite lower surface 58 engaging the respective bladder segments 64, 66 and 68, 70. Thus, the plates 30, 32 sandwich the respective bladder segments 64, 66 and 68, 70 between lower surface 58 of the top plates 30, 32 and the top surface 29 of the respective bottom plates 34, 36. See FIG. 5. A hinge 51 couples the head-end top plate 30 to the first raised block portion 40 of head-end bottom plate 34. Thus, the top plate 30 includes an inner hinged end 48 and an opposite outer head end-moving end 50. This head end-moving end 50 is raised and lowered on the head-end bottom plate 34 and is positioned adjacent the head end 14 of mattress 12. See FIG. 1. A hinge 49 couples the bottom-end top plate 32 to the second raised block portion 44. The bottom-end top plate 32 therefore includes an inner hinged end 52 and an opposite outer knee end-moving end 54 that is raised and lowered on the second bottom plate 36.

Figure 3:
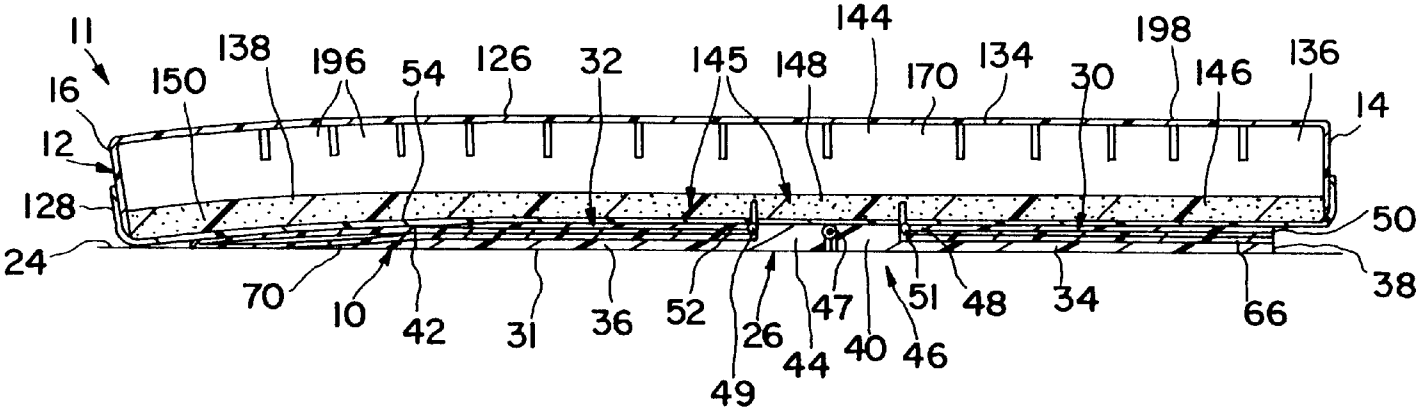
FIG. 3 is a sectional view taken along line 3—3 of FIG. 1 after both the head-end and foot-end bladders have been deflated so that the mattress is positioned to lie in a generally flat horizontal position.
Figure 4:
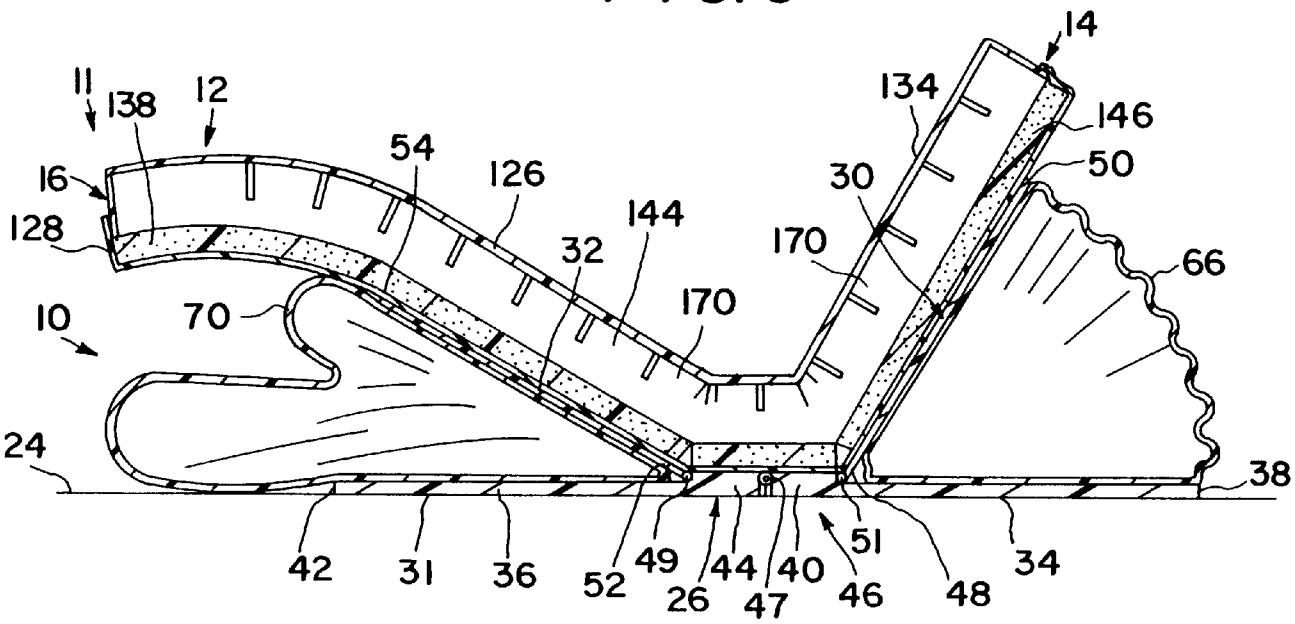
FIG. 4 is a view similar to FIG. 3 showing both the head-end and the foot-end bladders inflated so that the mattress is positioned to lie in an elevated position.

As best shown in FIG. 1, the knee end-moving end 54 of top plate 32 is spaced apart from the foot end 16 of the mattress 12. The positioning enables a user of the bed 11 to rest with a bend at the knees. This spaced apart positioning of the knee end-moving end 54 of the top plate 32 compared with the foot end 16 of the mattress 12 also allows the mattress 12 to rest upon the bladder segments 68, 70. Thus, when the bladder segments 68, 70 are inflated, as shown in FIG. 3, the foot end 16 of the mattress 12 is at most raised to the level of the knee end-moving end 54 of the top plate 32. One of ordinary skill in the art will readily appreciate that the bellows assembly 10 may be modified to adjust the relative distance between the hinged end 52 and the knee end-moving end 54 of the top plate 32 to fit small children and tall adults.

The bladder segments 64, 66, 68, 70 are disposed between the hinged top plates 30, 32 and the bottom plates 34, 36 of the base platform 26. The bladder segments 64, 66, 68, 70 each include top sides or walls 60 secured to the top plates 30, 32 respectively. The bladder segments 64, 66, 68, 70 also include bottom sides or walls 62 secured to the platform 26. The bladder segments 64, 66, 68, 70 are secured to the top plates 30, 32 and to the platform 26 by plates and fasteners as discussed below. It is understood, however, that other coupling means such as snaps, zippers or adhesives may be used to fix the bladder segments 64, 66, 68, 70 to the lower surface 58 of the top plates 30, 32 and to the top surface 29 of the first and second bottom plates 34, 36. It is important that the walls 60, 62 of the inflatable bladder segments 64, 66, 68, 70 be fastened to the top plates 30, 32, and to the base platform 26 to prevent sliding movement of the bladder segments 64, 66, 68, 70 during inflation and deflation.

As best shown in FIG. 5, the bellows assembly 10 includes four inflation bladder segments 64, 66, 68, 70 separated in a side-by-side relationship between the top plates 30, 32 and the bottom plates 34, 36 of the base platform 26. Specifically, bladder segments 64, 66 are shaped as an accordion when inflated, and are mounted between the top plate 30 and the bottom plate 34. Bladder segments 68, 70 have a pair of front lobes 72, 74 when inflated. Bladder segments 68, 70 are positioned to lie adjacent one another between the top plate 32 and the bottom plate 36. See FIG. 5. One of ordinary skill in the art will appreciate that the bladder segments 64, 66, 68, 70 each include webbing (not shown) therein to support their shape during inflation. Many commercially available compositions may be used in accordance with the present invention to construct bladder segments 64, 66, 68, 70. Bladder segments 64, 66, 68, 70 suitable for use with the present invention are constructed of a PVC or polyurethane coated nylon fabric. It is understood, however, that many commercially available fluid tight materials may be used to construct said bladder segments 64, 66, 68, 70.

To reduce shifting movement of the bellows assembly 10 on the box spring 24 during inflation and deflation of the bladder segments 64, 66, 68, 70, an attachment mechanism is provided for attaching the base platform 26 to the box spring 24 of the bed 11. In preferred embodiments, the attachment mechanism includes straps 77, 78 that are spaced-apart from one another along the base platform 26. See FIG. 1. The straps 77, 78 each include a first end 79, a second end 81, a latch portion 80 mounted on the first end 79, and a latch-receiving buckle portion 82 mounted on the second end 81. See FIG. 2. The first head-end bottom plate 34 has two spaced-apart slots 92, one of which is shown in FIG. 2, positioned to lie adjacent the first and second edges 18, 20 respectively. The raised block portion 40 has slots 96 positioned along the first and second edges 18, 20. It is understood that slots 96 could extend through the block portion 44 instead of the block portion 40. The straps 77, 78 extend across the top surface 29 of the base platform 26 and through slots 92, 96 respectively. The latch portion 80 is movable on straps 77, 78 to allow the bellows assembly 10 to be mounted on box springs that have different widths and depths. While two straps 77, 78 are illustrated, it is understood that less than or greater than two straps may be spaced-apart along the base platform 26.

To mount the bellows assembly 10 on the box spring 24, the latch portion 80 of each of the straps 77, 78 is extended around the box spring 24 and inserted into the respective latch-receiving buckle portion 82. Illustratively, the latch portion 80 of each strap 77, 78 extends around the box spring 24 in spaced-apart relation from one another to mount the base platform 26 on the box spring 24. One of ordinary skill in the art will recognize that the latch portion 80 may instead be mounted on the second end 81 of straps 77, 78 and the buckle portion 82 may be mounted on the first end 79 of straps 77, 78. In addition, it is understood that attachment mechanisms such as snaps, zippers, hook-and-eye, buttons, adhesives, and strings may be used in accordance with the present invention to hold the base platform 36 on the box spring 24.

To stabilize the positioning of the mattress 12 on the bellows assembly 10, especially during shifting and rolling movement of the user, a fastener mechanism is provided to fix the mattress 12 to the top plates 30, 32. The fastener mechanism includes ties 218 coupled to straps 216 that attach the mattress 12 to the top plates 30, 32. These ties 218 cooperate with the hinged top plates 30, 32 to prevent twisting of the mattress 12 on the top plates 30, 32. The ties 218 also provide side-to-side stability for the mattress 12 resting upon the bellows assembly 10 and effectively prevent the mattress 12 from sliding over the first and second edges 18, 20 of the platform 26. Details of the ties 218 are discussed below.

In preferred embodiments of the present invention, the mattress 12 has a cover 124 with a top cover 126 and a bottom cover 128 connected to top cover 126 by a zipper 132. See FIG. 2. The top cover 126 includes a generally upwardly-facing sleeping surface 134 above which a person rests. Top and bottom covers 126, 128 of mattress cover 124 cooperate to define an interior region 130 of mattress cover 124. Illustrative top cover 126 is semi-permeable allowing air to pass therethrough but sealing mattress 12 against the ingress of moisture. Such ticking material is well known for use with "low air loss" mattresses of the type disclosed in U.S. Pat. No. 4,949,414 to Thomas et al., the specification of which is hereby incorporated by reference.

Interior region 130 of mattress cover 124 receives a mattress core 136. Mattress core 136 includes a foam base 138 and an air mattress 144 positioned to lie above the foam base 138. See FIGS. 3 and 4. It is understood that the mattress 12 may also include side members (not shown) to lie above the foam base 138 and provide additional support for the person positioned on the sleeping surface 134 of mattress 12. Mattress cover 124 holds the elements of mattress core 136 together and provides an interface between the mattress 12 and the person supported on the top cover 126 of mattress 12.

The bottom cover 128 of the mattress 12 is formed to include bottom slots 161, only one of which is shown in FIG. 2. The slots 161 are positioned to lie along edge 20. The bottom cover 128 also includes two corresponding side slots 163 spaced apart along edge 18. The slots 161 along edge 20 and slots 163 are all sized to receive the straps 216 and ties 218 therethrough. In addition, the top plates 30, 32 include apertures 240 along edge 20 that are generally aligned with slots 161 along edge 20. See FIG. 2. Plates 30, 32 also include apertures 238 along edge 18 that are aligned with slots 163. See FIG. 2. Illustratively opposite apertures 240, 238 are formed through the foot-end top plate 32 adjacent the knee end-moving end 54 and apertures 240, 238 extend through the head-end top plate 30 adjacent the head end-moving end 50. See FIG. 5. The apertures 240, 238 in the top plates 30, 32 are sized to receive the ties 218 therethrough.

Ties 218 are attached to the respective top plates 30, 32 similarly. A user attaches the mattress 12 to the bellows assembly 10 by first pulling the ties 218 through the side apertures 161, 163 in the bottom cover 128 of mattress 12 as shown by arrows 171. See FIG. 2. The ties 218 are then pulled through the apertures 240, 238 positioned along edges 18, 20 and tied together to secure the mattress on the top plate 32.

In preferred embodiments, the foam base 138 of the mattress core 136 is made to articulate with the top plates 30, 32. The foam base 138 includes a plurality of longitudinally-spaced base sections 145 including a head section 146 next to the head end 14 of mattress 12, a seat section 148 next to the head section 146, and a leg section 150 next to both the seat section 148 and to the foot end 16 of mattress 12. See FIG. 3. Foam base 138 is made from foam rubber such as polyurethane foam that is well known and commonly used for producing foam mattresses. Each illustrative and preferred base section 145 is covered with the ticking such as the ticking material from which mattress cover 124 is made.

The air mattress 144 of mattress core 136 has a plurality of longitudinally-spaced apart and transversely-extending air bladders 170. See FIGS. 3 and 4. The air mattress 144 provides the mattress 12 with firmness and support characteristics that can be adjusted by varying the pressure within its bladders 170. Air mattress 144 includes four air bladders 170, although there is no theoretical limit to the number of air bladders 170 that can be included with air mattress 144. Each air bladder 170 is generally rectangular in shape when inflated and includes webbing 198 defining a plurality of transversely-extending tubes 196. See FIGS. 3–4. Webs 198 are integral with the outside walls of each air bladder 170 and are joined in air tight engagement with them. Thus, the bladders 170 are independent of each other and can be independently inflated or deflated. Although air bladders 170 of air mattress 144 are longitudinally-spaced apart and extend transversely, the shapes and relative positioning of air bladders 170 can be varied without exceeding the scope of the invention as presently perceived. The mattress 12 is described in more detail in pending U.S. application Ser. No. 08/663,994, filed on Jun. 14, 1996 and owned by the assignee of the present invention.

In preferred embodiments, the bellows assembly 10 is formed for connection with a source of pressurized fluid 90 to inflate and deflate bladder segments 64, 66, 68, 70 and thus articulate head and leg sections 146, 150 of mattress 12. A conduit 88 connects bladder 68 to the source of pressurized fluid 90 so that an interior region 102 of bladder 68 is in fluid communication with the source of pressurized fluid 90. See FIG. 2. A second conduit (not shown) connects bladder 68 with bladder 70 so that the interior region (not shown) of the bladder 70 is in fluid communication with the interior region 102 of the bladder 68. Thus, the interior regions (not shown) of the bladder segments 68, 70 are each in fluid communication with the source of pressurized fluid 90 and are therefore pressurized to substantially the same pressure.

a third conduit 97 connects the bladder 64 to the source of pressurized fluid 90 so that its interior region (not shown) is in fluid communication with the source of pressurized fluid 90. A fourth conduit (not shown) connects the bladder 64 with adjacent bladder 66 so that the interior region (not shown) of the bladder 64 is in fluid communication with the interior region (not shown) of the bladder 66. Thus, the interior region of bladder 64 and the interior region of bladder 66 are in fluid communication with the source of pressurized fluid 90. The pressurized fluid in each bladder 64, 66 is therefore pressurized to substantially the same pressure. Beneficially, the use of multiple bladder segments 64, 66, and 68, 70 in fluid communication with one another enables the bladder segments 64, 66 and 68, 70 to be equivalently pressurized and to provide stable elevation of the top plates 30, 32. In addition, the use of multiple spaced-apart bladder segments 64, 66, 68, 70, rather than a single bladder, requires less fluid for inflation and therefore enables the user to adjust more quickly the positioning of the head and foot ends 14, 16 of the bed 11.

a second source of pressurized fluid 91 is coupled to the air mattress 12 by conduit 101. Therefore, the first pressure source 90 includes two outlet conduits 88 and 97 for raising and lowering the foot section bellows 68 and 70 and the head section bellows 64 and 68. The second pressurized fluid source 91 operates to control the low air loss mattress 12. Therefore, the stacked blower unit assembly including modules 90 and 91 cooperate to operate both the articulating bellows assembly 10 and the low air loss mattress 12.

Figure 6:
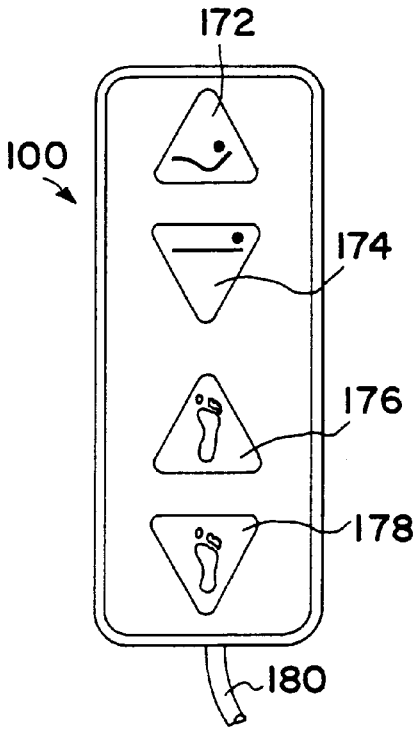
FIG. 6 is a top plan view of a control pad suitable for use with the present invention and showing the control pad having four control buttons.

The pressurized fluid is pressurized air and the sources of pressurized fluid 90 and 91 are air blowers or air compressors. In preferred embodiments, the source 90 is mounted on the frame 22 of the bed 11 and includes a controller 100 to permit the user to control the operation of the source of pressurized fluid 90 over a range of desired supply pressures. See FIGS. 2, 6, and 9. Controller 100 permits the user to control the voltage supplied to the blower by providing an input signal and thus adjust the head and foot elevation of the bellows assembly 10 (and/or patient).

Although the preferred pressurized fluid is air, the source of pressurized fluid 90 for the bellows assembly 10 described herein will operate as described when the pressurized fluid is nitrogen or any other generally inert gas. Thus, it is within the scope of the invention as presently perceived to provide a bellows assembly 10 for use with any suitable generally inert gas. In addition, although the preferred source of pressurized fluid 90 is a blower, the source of pressurized fluid 90 can be a container or tank containing pressurized fluid, a "house" gas line containing pressurized fluid, or any other suitable source of pressurized fluid without exceeding the scope of the invention as presently perceived.

The user of the bellows assembly 10 manipulates the source of pressurized fluid 90 by using the controller 100. See FIG. 6. The controller 100 includes several functions that correspond with pre-determined articulation sequences of the bed 11. The controller 100 has a head and foot elevation button 172, a head and foot depression button 174, a foot elevation button 176, and a foot depression button 178. The controller 100 is connected to the source of pressurized fluid 90 by a connecting cable 180. The controller 100 may then freely be moved to any position within the length of the connecting cable 180 that is accommodating to the person situated on the sleeping surface 134 of the bed 11. One of ordinary skill in the art will recognize that the controller 100 may include a variety of control functions and be in electronic communication with the source of pressurized fluid 90 using a variety of commercially available remote-control options.

To actuate a bed 11 that incorporates the bellows assembly 10 of the present invention, the user must simply pick a desired elevated position and then select the corresponding control function button 172, 174, 176, 178 on the controller 100. Normally, the bladder segments 64, 66, 68, 70 rest in a substantially flat position against the platform 26 causing the mattress 12 to be in a substantially horizontal sleeping position. See FIG. 3. To move the head section 146 and leg section 150 of the foam base 138 and thus the mattress 12 to the elevated position illustrated in FIG. 1, a user presses the head and foot elevation button 172 on the controller 100. Pressing button 172 sends a signal from the controller 100 to the source of pressurized fluid 90. The source of pressurized fluid 90 directs fluid flow through conduits 88 and 97. Thus, fluid begins simultaneously filling the bladder segments 64, 68 and therefore bladder segments 66, 70. As pressurized fluid flows from source 90 into the bladder segments 64, 66, 68, 70, the bladder segments 64, 66, 68, 70 inflate to cause the top plates 30, 32 to pivot on the raised block portions 40, 44 of the base platform 26. This pivoting movement actuates the mattress 12 to an elevated position (FIG. 1). Once the user has reached a comfortable elevated position, the user must simply release the button 172.

To return the mattress 12 to the flat substantially horizontal position (FIG. 3), the user presses the head and foot depression button 174 on the controller 100. Pressing button 174 sends a signal to the source of pressurized fluid 90 that releases the pressure in conduits 88, 104 allowing the bladder segments 64, 66, 68, 70 to deflate. If the user, however, only wishes to lower the leg section 150 of the foam base 138 and thus the foot end 16 of the mattress 12 from the elevated position of FIG. 1, the user presses the foot depression button 178. A signal is then sent to the source of pressurized fluid 90 to release the pressure only in conduit 88 and thus bladder segments 68, 70. The drop in pressure causes the front lobes 72, 74 of the top wall 60 of the bladder segments 68, 70 to collapse toward the bottom wall 62.

Alternatively, if a user wishes to only raise the leg section 150 of the foam base 138 from the flat position of FIG. 3 or further raise the leg section 150 from the elevated position of FIG. 1, the user presses the foot elevation button 176. A signal is then sent to the source of pressurized fluid 90 causing the fluid to flow through the conduit 88 and into the bladder 68. While a variety of control functions have been described, one of ordinary skill in the art will appreciate that control functions in addition to or different from those set out may be included on a controller 100 suitable for use with the present invention.

Figure 7:
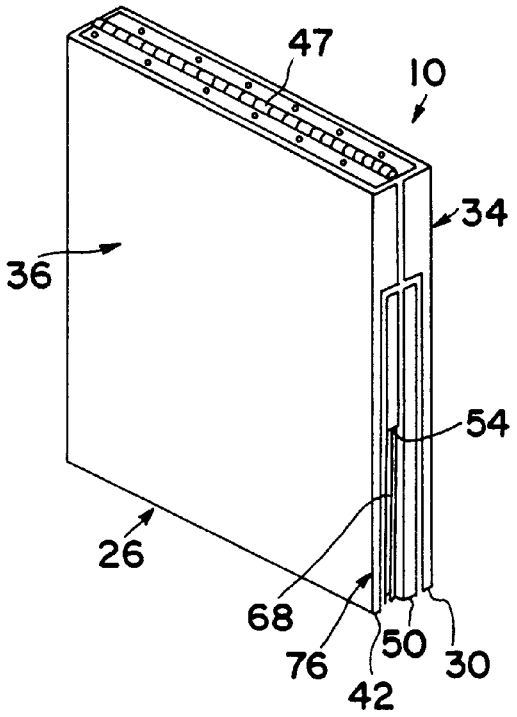
FIG. 7 is a perspective view of the bellows assembly of the present invention in a folded position.

Therefore, the control feature of the present invention always simultaneously lifts the leg section top plate 32 when the head section top plate 30 is raised. This reduces the likelihood that a patient will slide toward a foot end of the mattress 12. The foot section top panel 32 can be raised independently using controls 176 and 178. However, the head section top panel 30 cannot be elevated without the foot section top panel 32 also being elevated. Once the head section top panel 30 and foot section top panel 32 are moved to the elevated position as shown in FIG. 7, the foot section top panel 32 may be pivoted downwardly by releasing air from the foot section bladders 68 and 70 using control button 178.

In preferred embodiments of the present invention, the bellows assembly 10 is portable. The bellows assembly 10 is detached from the box spring 24 by releasing the latch portion 80 of the straps 77, 78 from the corresponding latch-receiving buckle portion 82. The bellows assembly 10 is detached from the mattress 12 by untying the ties 218 on the mattress from the top plates 30 and 32. In addition, the pivot hinge 47 that is situated between the first and second raised block portions 40, 44 permits the bellows assembly 10 to assume a folded position. See FIG. 7. This folded position, enables a user to transport the bellows assembly 10 easily for use in a variety of beds 11.

Figure 8:
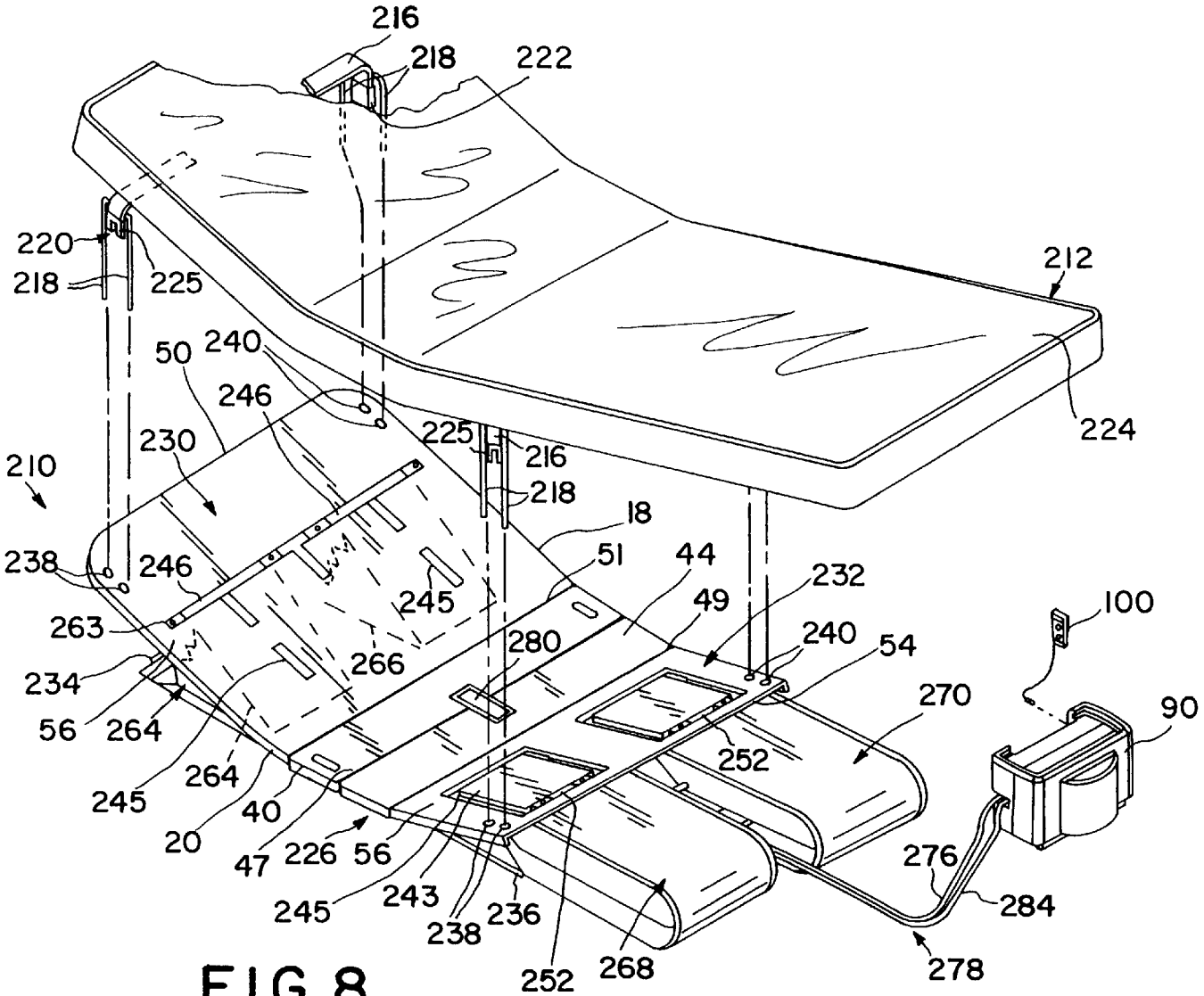
FIG. 8 is an exploded perspective view of an alternative embodiment of the mattress and the bellows assembly of the present invention, showing the mattress having ties and the bellows assembly having a head-end top plate and a foot-end top plate pivotably hinged to a base platform, each top plate having apertures for receiving the ties and being formed to receive a portion of the bladder segments therethrough and the base platform being formed to receive a living hinge.

In an alternative embodiment of the present invention, a bellows assembly 210 is configured to support a mattress 212 that includes a cover 224 and flexible straps 216 bonded to a bottom surface of the mattress 212 to fix the mattress 212 to the bellows assembly 210. As best shown in FIG. 8, the flexible straps 216 include a set of ties 218 and a buckle assembly 220 that includes a buckle portion 222 and a latch portion 225.

Figure 10:
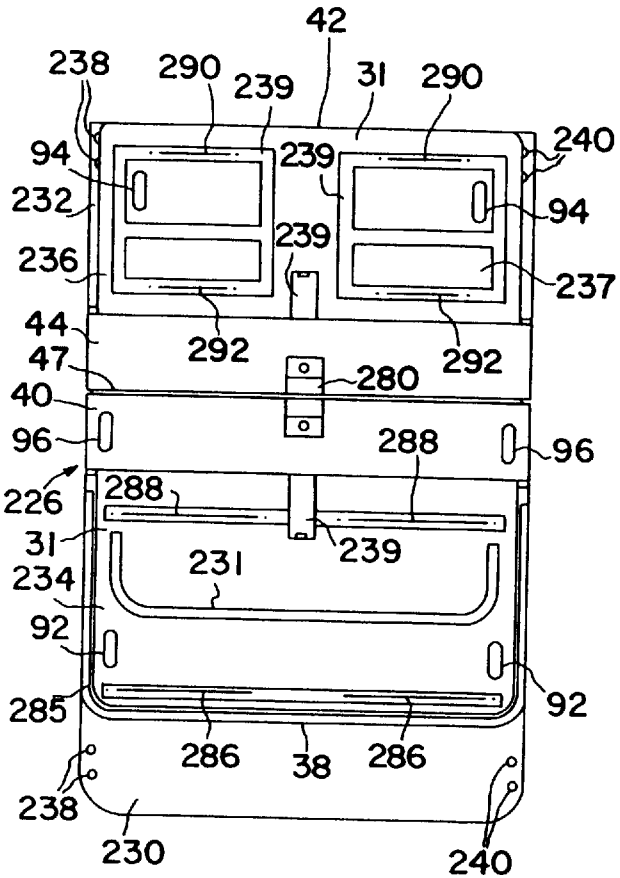
FIG. 10 is a bottom view of the bellows assembly of FIG. 8 prior to attachment of the sets of bladder segments thereon and showing the relative positioning of the head-end top plate and the foot-end top plate on the base platform and showing the head-end top plate being formed to receive a U-shaped support bar therein, the head-end and foot-end top plates having mounting slots and the base platform having three sets of spaced-apart belt-receiving slots.

The bellows assembly 210 includes a base platform 226, inflatable bladder segments 264, 266, 268, 270 resting on the base platform 226, and top plates 230, 232 mounted on the base platform 226 and formed to support the mattress 212. The base platform 226 includes a first head-end bottom plate 234 and a second foot-end bottom plate 236 coupled together. Pivot hinge 47 is positioned between block portions 40, 44. As best shown in FIG. 10, the bottom plates 234, 236 include raised portions 237 and recessed portions 239 within the bottom surface 31. Illustratively, a U-shaped aluminum support bar 231 is located in a U-shaped recess formed in the bottom surface of bottom plate 234. U-shaped support bar 231 strengthens the bottom plate 234. Another U-shaped aluminum support bar 285 is coupled to a bottom surface of top plate 230. Illustratively, U-shaped support bar 285 is located within a U-shaped recess formed in the bottom surface of top plate 230 to strengthen the top plate 230.

The top plates 230, 232 are coupled to the base platform 226 by hinges 51, 49 respectively. As best shown in FIG. 8, the top plates 230, 232 include apertures 238 along edge 20 that are generally aligned with apertures 240 along edge 18. Illustratively, opposite apertures 238, 240 are formed through the foot-end top plate 232 adjacent the knee end-moving end 54 and opposite apertures 238, 240 extend through the head-end top plate 230 adjacent the head end-moving end 50. The apertures 238, 240 in the top plates 230, 232 are sized to receive ties 218 therethrough. Ties 218 pass through apertures 238 and 240 to secure the mattress 212 to the bellows assembly 210. In addition, the top plate 232 includes a disrupted upper surface 56 that includes raised portions 243 and recessed portions 245.

Figure 9:
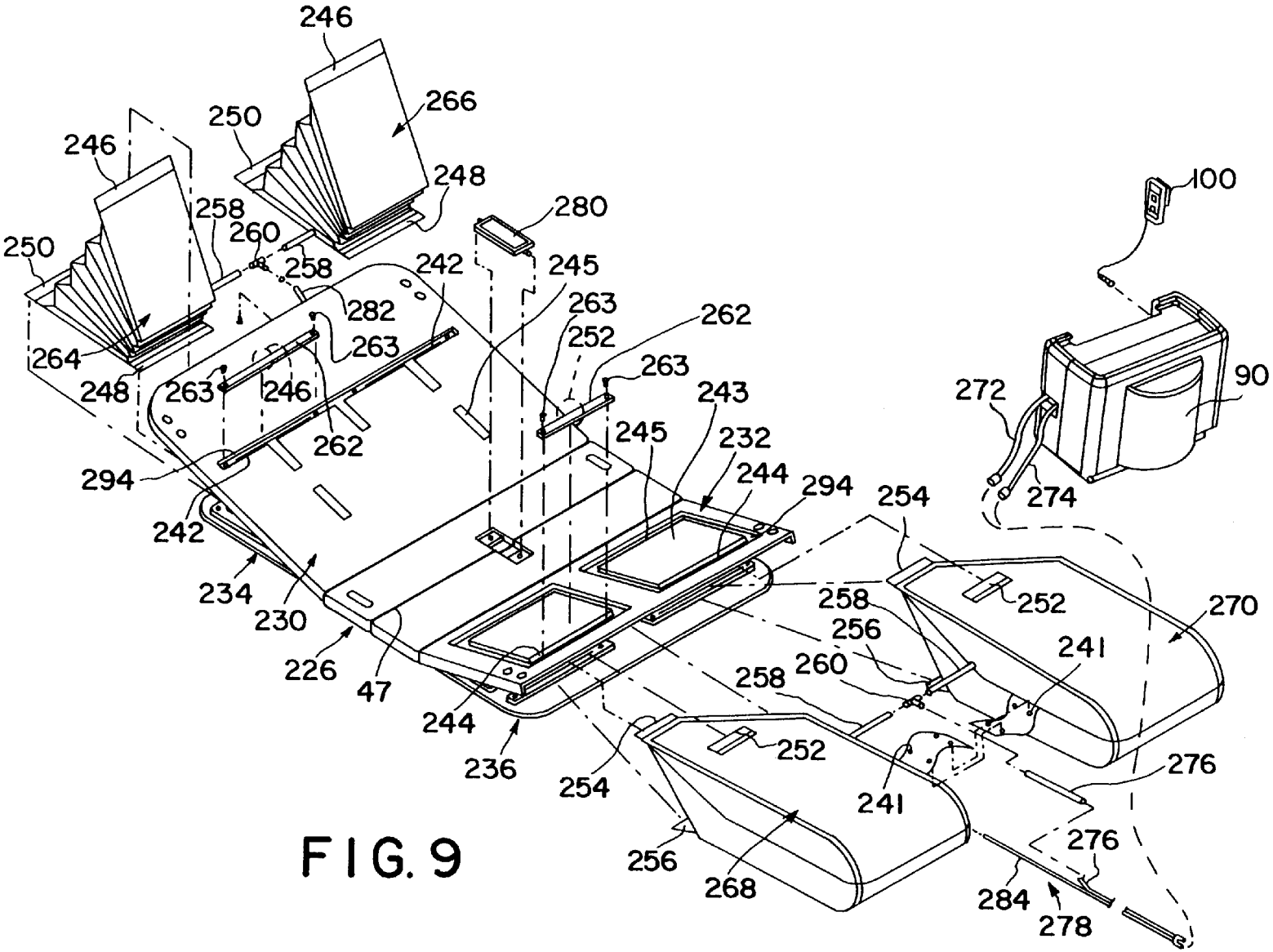
FIG. 9 is a perspective view of the bellows assembly of FIG. 8 showing bladder segments including mounting tabs thereon and the top plates including mounting slots for receiving the mounting tabs, a mounting bracket for coupling the mounting tabs to the top plates, and also showing a source of pressurized fluid having two conduits extending therefrom, one conduit extending to one set of bladder segments and a conduit assembly extending between the top plates and the base platform in fluid communication with the living hinge and the second set of bladder segments.

Referring now to FIG. 9, the bladder segments 264, 266, 268, 270 are coupled to the top plates 230, 232 and to the first head-end and the second foot-end bottom plates 234, 236. Illustratively, the bladder segments 264, 266, 268, 270 include vents 241 therein to permit deflation. The head-end top plate 230 includes mounting slots 242 and the foot-end top plate 232 includes mounting slots 244. The bladders segments 264, 266 each include a top mounting loop tab 246 that is sized for insertion into one of the mounting slots 242, an innermost loop tab 248, and an outermost loop tab 250. The bladder segments 268, 270 each include a top mounting loop tab 252 that is sized for insertion into one of the mounting slots 244, an innermost loop tab 254, and a bottom loop tab 256. As will be discussed in greater detail hereafter, the loop tabs 246, 252 are held within the slots 242, 244 by mounting brackets 262 and rivets 263. It is understood that a the mounting brackets 262 may be configured in a variety of sizes and shapes to accommodate the tabs 246, 252 and slots 242, 244. Moreover, it is understood that a wide variety of pins, screws, rods, and the like may be used to attach the mounting brackets with the top plates 230, 232.

The source of pressurized fluid 90 is suited for use with the assembly 210. As shown in FIG. 9, the source of pressurized fluid 90 includes first and second air tubes 272, 274 that extend therefrom. The air tubes 272, 274 are configured for fluid communication with bladder segments 264, 266 and bladder segments 268, 270 respectively. The bladder segments 264, 266 and bladder segments 268, 270 each include inlet tubes 258 coupled together respectively by T-joint tubes 260. A foot-end feeder tube 276 is configured to extend between the T-joint tube 260 and the second air tube 274. Likewise, a head-end feeder tube assembly 278 extends between the T-joint tube 260 of the bladder segments 264, 266 and the first air tube 272.

The head-end feeder tube assembly 278 extends through the assembly 210 between the top plates 230, 232 and the bottom plates 234, 236. Further, the head-end feeder tube assembly 278 includes a living hinge 280 that spans across the hinge 47, a first feeder tube portion 282 that extends between the living hinge 280 and the T-joint tube 260, and a second feeder tube portion 284 that extends between the living hinge 280 and the first air tube 272. See FIG. 9. While a connection is illustrated between the separate air tubes 272, 274 and the foot-end feeder tube 276 and the head-end feeder tube assembly 278 respectively, it is understood that the foot-end feeder tube 276 and the head-end feeder tube assembly 278 may be inserted directly into the source of pressurized fluid 90. Moreover, the foot-end feeder tube 276 and the head-end feeder tube assembly 278 may be fed directly into the bladder segments 264, 266, 268, 270. The arrangement illustrated in FIGS. 8 and 9 permit both supply lines 272 and 274 be attached adjacent the foot end of bellows assembly 210.

The first head-end bottom plate 234 includes outer mounting slots 286 adjacent the outer end 38 and inner mounting slots 288 adjacent the block portion 40. See FIG. 10. The outer mounting slots 286 are sized to receive the outermost tab 250 of the bladder segments 264, 266 therein. The inner mounting slots 288 are sized to receive the innermost tab 248 of the bladder segments 264, 266 therein. It is understood that the number of slots 286, 288 as well as their relative positioning may vary in accordance with the present invention.

Likewise, the second foot-end bottom plate 236 includes outer mounting slots 290 adjacent the outer end 42 and inner mounting slots 292 adjacent the block portion 44. The outer mounting slots 290 are sized to receive the bottom tab 256 of the bladder segments 268, 270 therein. The inner mounting slots 292 are sized to receive the innermost tab 254 of the bladder segments 268, 270 therein. It is understood that the number of slots 290, 292 as well as their relative positioning may vary in accordance with the present invention.

Figure 12:
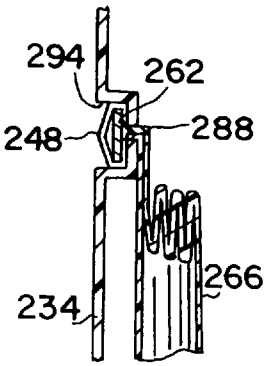
FIG. 12 is a cross-sectional view taken along line 12—12 of FIG. 11 and showing the mounting tab of the bellow segment extending through the mounting slot and being formed as a loop and showing the mounting bracket extending through the loop.
Figure 11:
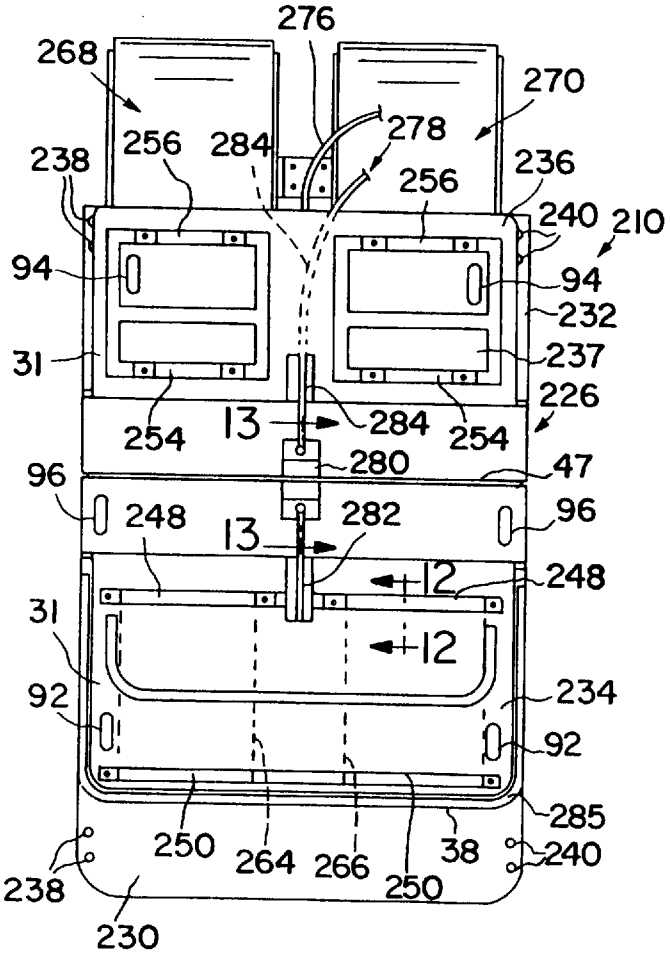
FIG. 11 is a bottom view of the bellows assembly of FIG. 10 following attachment of the sets of bladder segments and showing first and second feeder tube portions in communication with the living hinge and extending between the foot-end top plate and the base platform.

As best shown in FIG. 12, the mounting tab 248 of the bladder segment 266 extends through the mounting slot 288. The mounting tab 248 is formed as a loop and is sized to receive the mounting bracket 262 therethrough. The mounting bracket 262 has a diameter that is greater than the diameter than the mounting slot 288. Therefore, once the mounting bracket 262 is coupled to the mounting tab 248, the bladder segment 266 is prevented from pulling away from the bottom plate 234. Illustratively, the bottom plate 234 includes a pocket 294 that is sized to receive the mounting bracket 262 therein. It is understood that while only mounting tab 248 of the bladder segment 266 extending through the mounting slot 288 is illustrated in FIG. 12, the mounting tabs 250, 254, and 256 are coupled to the base platform 226 in a similar manner. Likewise, it is understood that the top plates 232, 234 include pockets 294 to receive the mounting brackets 262 therein and the mounting tabs 246, 252 are coupled to the top plates 232, 234 in a manner similar to that illustrated in FIG. 12. Once the mounting bracket 262 is inserted through tab 248, the mounting bracket 262 is secured to bottom plate 234 by pop rivets 263.

Figure 13:
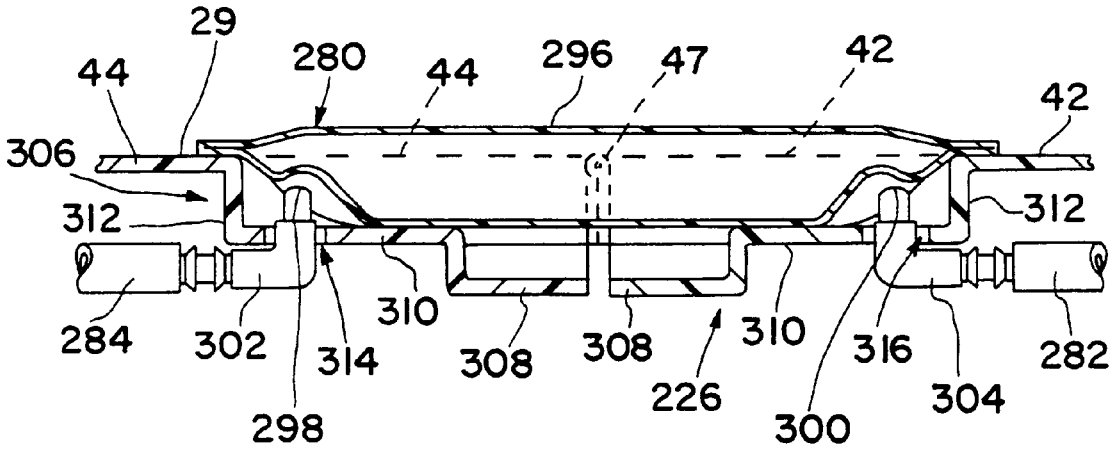
FIG. 13 is a cross-sectional view taken along line 13—13 of FIG. 11 and showing the living hinge including a flexible sack and an inlet joint and an outlet joint coupled to the flexible sack and showing the first and second feeder tube portions coupled to the inlet and outlet joints.
Figure 14:
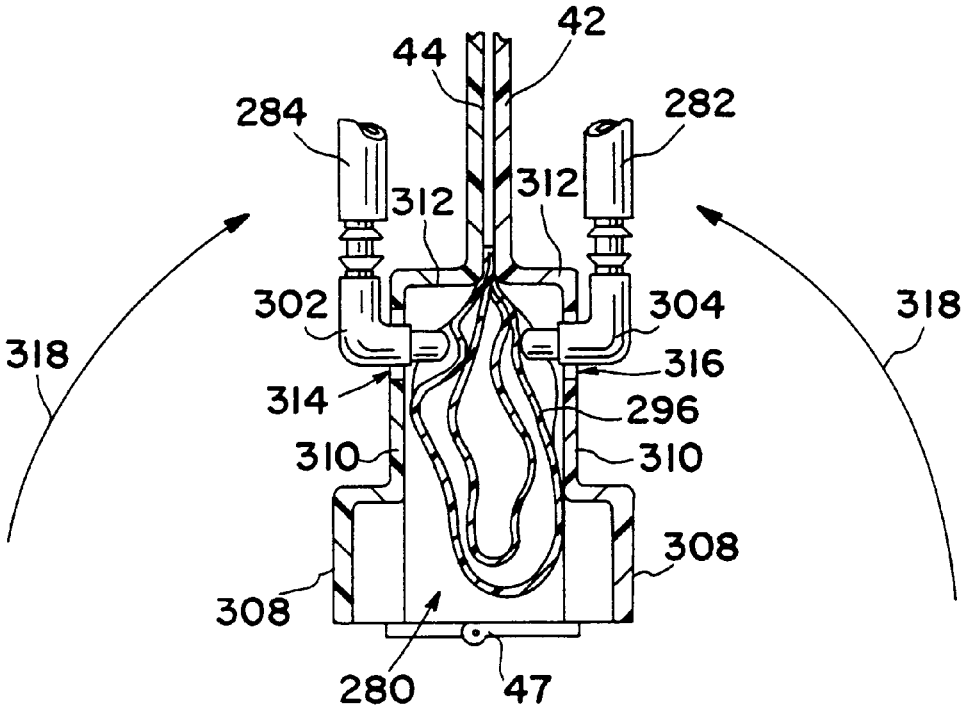
FIG. 14 is a cross-sectional view similar to FIG. 13 showing the living hinge and the base platform in a folded position.

Referring now to FIG. 13, a recessed portion 306 is formed within the top surface 29 of the base platform 226 and is configured to span the hinge 47. The recessed portion 306 includes a recessed floor portion 308, an elevated floor portion 310, and side walls 312 extending upwardly from the elevated floor portion 310. In addition, the elevated floor portion 310 is formed to include an inlet aperture 314 and an outlet aperture 316 therethrough. The recessed portion 306 is sized to receive the living hinge 280 therein. The living hinge 280 includes a flexible sack 296 having an inlet 298 and an outlet 300. An inlet joint 302 extends into the inlet 298 and through the inlet aperture 314 where it is coupled to the second feeder tube portion 284. In addition, an outlet joint 304 extends into the outlet 300 and through the outlet aperture 316 where it is coupled to the first feeder tube portion 282. Thus, the flexible sack 296 enables the first feeder tube portion 282 and the second feeder tube portion 284 to be in fluid communication with one another. The flexible sack 296 also enables the base platform 226 to fold as shown by arrows 318 in FIG. 14 without bending the feeder tube portions 282, 284 of the head-end feeder tube assembly 280. Therefore, the feeder tube portions 282 and 284 do not need to be disconnected to fold the base platform 226.

Beneficially, the cooperation of the ties 218 and the top plates 30, 32 provides stability to an articulating air mattresses 12 or 212, especially during rolling and twisting movements of the user. In addition, the foldable features of the base platform 26 allow the user to transport the bellows assembly 10 or 210 for quick installation in a new location for use with the same or a different mattress 12. Therefore the bellows assembly 10 or 210 of the present invention allows the user to convert a box spring 24 on a bed 11 to an articulatable platform while providing stability to the mattress 12 or 212, especially during movement of the person positioned on the mattress 12 or 212. The buckle portion 222 and latch portion 225 on mattress 212 are used with an extender strap (not shown) to secure the mattress 212 directly to a foundation such as box spring 24 without using the bellows assembly 210.

Although the invention has been described in detail with reference to a preferred embodiment, variations and modifications exist within the scope and spirit of the invention as described and defined in the following claims.

What is claimed is:

1. A structure for converting a platform such as a box spring on a bed to an articulatable platform for the bed, the structure comprising:

a mattress, a base platform formed to rest on the box spring, the base platform having a head end and an opposite foot end and first and second edges extending between the head and foot ends, a first top plate and a second top plate each hinged to the base platform, a head-end bladder fastened between the first top plate and the base platform, a foot-end bladder fastened between the second top plate and the base platform, a fastener mechanism for holding the mattress on the top plates, the fastener mechanism being formed to prevent substantial sliding movement of the mattress over the first and second edges of the base platform, and an attachment mechanism including at least one strap coupled to the base platform and configured to extend around the box spring to hold the base platform on the box spring, the base platform including a head-end bottom plate, a foot-end bottom plate, and a central raised block portion situated between the bottom plates and the top plates being each hinged to the central block portion, and the head-end and foot-end bottom plates being each formed to include a set of spaced-apart slots extending therethrough and the attachment mechanism extending through the sets of slots.

2. The structure of claim 1, wherein the mattress has a head end, a foot end, and a middle portion extending therebetween, and the second top plate includes an inner end hinged on the base platform and an opposite knee end-moving end positioned to lie in a spaced-apart relationship from the foot end of the mattress.

3. The structure of claim 2, wherein the first top plate includes an inside end hinged on the base platform and an opposite head end-moving end positioned to lie adjacent the head end of the mattress.

4. The structure of claim 2, wherein the fastener mechanism includes at least two straps positioned to lie in a spaced-apart relationship to one another, the straps including ties to secure the mattress to the first and second top plates.

5. The structure of claim 4, wherein the first and second top plates are each formed to include spaced-apart apertures and each of the apertures is sized for insertion of one of the ties therethrough.

6. The structure of claim 4, further comprising a buckle coupled to each strap.

7. The structure of claim 5, wherein the first and second top plates each include a first edge, an opposite second edge, a first aperture positioned adjacent the first edge, and a second aperture positioned adjacent the second edge, and apertures are each sized for insertion of one of the ties therethrough.

8. The structure of claim 1, wherein the base platform is formed to include opposite edges and three sets of slots extending therethrough and each set of slots includes one slot that extends through the base platform along one edge and a second corresponding slot that extends through the base platform along the opposite edge.

9. The structure of claim 8, wherein the first set of slots extends through the head-end bottom plate adjacent the head end of the base platform, the second set of slots extends through the foot-end bottom plate adjacent the opposite foot end of the base platform, and the third set of slots extends through the central raised block portion.

10. The structure of claim 1, wherein the raised central block portion includes hinge so that the base platform folds to form a compact folded assembly.

11. The structure of claim 1, further comprising means for inflating and deflating the bladders.

12. An articulatable structure for use with a mattress upon which a person rests, the structure comprising:

a base platform including a hinge to permit folding of the base platform, a head plate pivotably coupled to the base platform for supporting a head portion of the mattress, a knee plate pivotably coupled to the base platform for supporting a leg portion of the mattress, a first bladder located between the base platform and the head plate to raise and lower the head plate, a second bladder located between the base platform and the knee plate to raise and lower the knee plate, a controller for selectively inflating and deflating the first and second bladders to raise the head and knee plates and the head and leg portions of the mattress located thereon, the controller being configured to inflate the second bladder each time an operator inflates the first bladder so that the knee plate always moves to an elevated position as the head plate is elevated, and a fluid conduit coupled to the first bladder, the fluid conduit including a living hinge located over the hinge of the base platform.

13. The structure of claim 12, wherein the controller is configured to permit independent inflation and deflation of the second bladder to raise and lower the knee plate independently of the head plate.

14. The structure of claim 12, wherein the first and second bladders include at least one mounting loop tab extending through slots formed in the head plate and knee plate, respectively, and mounting fasteners extending through the tabs and coupled to the head plate and the knee plate to secure the first and second bladders to the head plate and knee plate, respectively.

15. The apparatus of claim 12, further comprising an attachment mechanism for securing the base platform to a foundation.

16. A bed comprising:

a base platform including a first bottom plate and a second bottom plate coupled to the first bottom plate by a hinge, first and second top plates, each top plate having opposite edges and an inner hinged end extending between the opposite edges and being pivotally coupled to the base platform, a first bladder positioned between the first top plate and the base platform, a second bladder positioned between the second top plate and the base platform, an air mattress positioned to lie on the first and second top plates, a first source of pressurized fluid coupled to the air mattress, a second source of pressurized fluid, a first tube extending between the second source of pressurized fluid and the first bladder, the first tube including a living hinge that extends across the hinge between the first and second bottom plates, and a second tube extending between the second source of pressurized fluid and the second bladder.

17. The bed of claim 16, wherein the top plates include apertures therethrough and the air mattress includes ties sized for extension through the apertures to couple the air mattress to the top plates.

18. The bed of claim 16, wherein the air mattress is a low air loss mattress.

19. A structure for converting a platform to an articulatable platform that supports a mattress thereon, the structure comprising:

a base platform having a first bottom plate, a second bottom plate, and a hinge coupled to the first and second bottom plates to permit folding of the first and second bottom plates, first and second top plates, each top plate having opposite edges and an inner hinged end extending between the opposite edges and being pivotally coupled to the base platform, a first bladder positioned to lie between the first top plate and the first bottom plate, a second bladder positioned to lie between the second top plate and the second bottom plate, a first conduit coupled to the first bladder for supplying fluid to the first bladder, and a conduit assembly coupled to the second bladder for supplying fluid to the second bladder, the conduit assembly including a tube and a living hinge extending across the hinge between the first and second bottom plates.

20. The structure of claim 19, wherein the first conduit is positioned to lie between the first top plate and the first bottom plate.

21. The structure of claim 20, wherein the first bladder includes bladder segments, inlet tubes coupled to the bladder segments, a joint coupled to the inlet tubes, and the first conduit is coupled to the joint.

22. The structure of claim 21, wherein the tube of the conduit assembly is positioned to lie between the first and second top plates and the first and second bottom plates.

23. The structure of claim 22, wherein the living hinge includes opposite ends and the tube includes a first segment coupled to the second bladder and to one end of the living hinge and a second segment coupled to the opposite end of the living hinge.

24. The structure claim 20, wherein the first bladder is coupled to the first top and bottom plates and the second bladder is coupled to the second top and bottom plates.

25. A structure for converting a platform to an articulatable platform that supports a mattress thereon, the structure comprising:

a base platform being formed to include at least one mounting slot therethrough, first and second top plates, each top plate being formed to include opposite edges, an inner hinged end extending between the opposite edges and being pivotally coupled to the base platform, and at least one mounting slot extending therethrough, a first bladder positioned to lie between the first top plate and the base platform and including at least one top tab sized for extension through the at least one mounting slot in the first top plate and at least one bottom tab sized for extension through the at least one mounting slot in the base platform, a second bladder positioned to lie between the second top plate and the base platform and including at least one top tab sized for extension through the at least one mounting slot in the second top plate and at least one bottom tab sized for extension through the at least one mounting slot in the base platform, and mounting brackets coupled to the top and bottom tabs, the mounting brackets being configured to prevent the top and bottom mounting tabs from sliding through the mounting slots and to hold the first and second bladders between the first and second top plates and the base platform.

26. The structure of claim 25, wherein the mounting tabs are formed as a loop and the mounting brackets are sized for insertion through the loop of each tab.

27. The structure of claim 26, wherein the top plates are formed to include a recessed portions therein and the mounting tabs are positioned to lie within the recessed portion.

28. The structure of claim 26, wherein the base platform is formed to include bottom recessed portions therein and mounting tabs are positioned to lie within the bottom recessed portions.

29. A structure for converting a platform such as a box spring on a bed to an articulatable platform configured to receive a mattress, the structure comprising:

a base platform formed to rest on the box spring, the base platform having a head end and an opposite foot end, and first and second edges extending between the head and foot ends, the base platform being formed to include at least one set of spaced-apart slots extending therethrough, a first top plate and a second top plate each hinged to the base platform, a head-end bladder fastened between the first top plate and the base platform, a foot-end bladder fastened between the second top plate and the base platform, and an attachment mechanism configured to hold the base platform on the box spring, the attachment mechanism extending through the at least one set of slots.

30. The structure of claim 29, wherein the base platform includes a head-end bottom plate, a foot-end bottom plate, and a central raised block portion situated between the bottom plates and the top plates are each hinged to the central block portion.

31. The structure of claim 30, wherein the mattress has a head end, a foot end, and a middle portion extending therebetween and the second top plate includes an inner end hinged on the base platform and an opposite knee end-moving end positioned to lie in a spaced-apart relationship from the foot end of the mattress.

32. The structure of claim 30, wherein the first top plate includes an inside end hinged on the base platform and an opposite head end-moving end positioned to lie adjacent the head end of the mattress.

33. The structure of claim 32, wherein the attachment mechanism includes belts positioned to lie in a spaced-apart relationship to one another.

34. The structure of claim 33, wherein the inflating and deflating means is an air pump.

35. An apparatus configured to support a mattress thereon, the apparatus comprising:

a base platform adapted to rest on the box spring, the base platform being formed to include at least one set of spaced-apart slots extending therethrough, a plate hinged to the base platform, a bladder fastened between the plate and the base platform, a fastener mechanism coupled to the plate and adapted to block sliding movement of the mattress relative to the plate, and at least one strap coupled to the base platform, the at least one strap extending through the at least one set of slots and being configured to extend around the box spring to hold the base platform on the box spring.

36. The apparatus of claim 35, wherein the fastener mechanism includes a belt.

37. The apparatus of claim 35, wherein the plate is formed to include spaced-apart apertures and each of the apertures is sized for insertion of the fastener mechanism therethrough.

38. The apparatus of claim 35, further comprising a second plate hinged to the base platform and the fastener mechanism includes two belts positioned to lie in a spaced-apart relationship to one another to couple the mattress to the first and second plates.

39. The apparatus of claim 38, wherein the plates each include a first edge, an opposite second edge, a first aperture positioned adjacent the first edge, and a second aperture positioned adjacent the second edge, and apertures are each sized for insertion of one of the belts therethrough.

40. The apparatus of claim 35, further comprising a first reinforcement bar coupled to the base platform, and a second reinforcement bar coupled to the plate.

41. An apparatus configured to support a mattress, the apparatus comprising:

a base platform having a first plate, a second, plate, and a hinge coupled to the first and second plates to permit folding of the first and second plates, a first bladder located on the first plate, a second bladder located on the second plate, a first conduit coupled to the first bladder to supply fluid to the first bladder, and a second conduit coupled to the second bladder to supply fluid to the second bladder, the second conduit including a living hinge extending across the hinge between the first and second plates, the living hinge being foldable with the first and second plates.

42. The apparatus of claim 41, wherein the living hinge includes first and second ends, and the second conduit includes a first tube segment coupled between the second bladder and the first end of the living hinge and a second tube segment coupled to the second end of the living hinge.

43. An articulatable apparatus configured to support a mattress thereon, the apparatus comprising:

a base platform formed to include a first mounting slot extending therethrough, a plate pivotably coupled to the base platform, the plate being formed to include a second mounting slot extending therethrough, a bladder positioned to lie between the plate and the base platform, the bladder including a first portion sized for extension through the first mounting slot and a second portion sized for extension through the second mounting slot, first and second mounting brackets coupled to the first and second portions of the bladder, respectively, the mounting brackets being configured to prevent the first and second portions of the bladder from sliding through the first and second mounting slots, to hold the bladder between the plate and the base platform.

44. The apparatus of claim 43, respectively, wherein the first and second portions of the bladder are each formed as a loop and the first and second mounting brackets are sized for insertion through the loops of first and second portions, respectively.

45. The apparatus of claim 43, wherein the plate is formed to include a recessed portion therein and the second mounting bracket is configured to lie within the recessed portion.

46. The structure of claim 45, wherein the base platform is formed to include a recessed portion therein and the first mounting bracket is configured to lie within the recessed portion of the base platform.

47. The structure of claim 43, further comprising a first reinforcement bar coupled to the base platform, and a second reinforcement bar coupled to the plate.

48. The structure of claim 47, wherein the first and second reinforcement bars are generally U-shaped.

49. The apparatus of claim 43, further comprising an attachment mechanism for securing the base platform to a foundation.

* * * * *